United States Patent [19]

Pozzi

[11] Patent Number: 4,967,907

[45] Date of Patent: Nov. 6, 1990

[54] SUPPORTING STRUCTURE FOR QUICK LOADING OF YARN SPOOLS IN DYEING AND DRYING MACHINES OR OTHER PROCESSING DEVICES

[75] Inventor: Leopoldo Pozzi, Milan, Italy

[73] Assignee: Pozzi Leopoldo S.p.A., Milan, Italy

[21] Appl. No.: 365,121

[22] Filed: Jun. 12, 1989

[30] Foreign Application Priority Data

Aug. 11, 1988 [IT] Italy ..... 21700 A/88

[51] Int. Cl.[5] ..... B65D 85/67

[52] U.S. Cl. ..... 206/392; 206/391; 206/394; 206/821

[58] Field of Search ..... 206/389, 391, 392, 394, 206/393, 408, 559, 560, 561, 485, 821; 242/118.41

[56] References Cited

U.S. PATENT DOCUMENTS

| | | | |
|---|---|---|---|
| 542,014 | 7/1895 | Glaeser | 206/561 |
| 2,007,914 | 7/1935 | Elling | 206/394 |
| 2,276,959 | 3/1942 | Goldsmith | 206/391 |
| 2,610,735 | 9/1952 | Ferguson | 206/392 |
| 3,227,272 | 1/1966 | Critzer | 206/392 |
| 3,281,033 | 10/1966 | Stutzman et al. | 206/394 |
| 3,335,858 | 8/1967 | Sibille | 206/392 |
| 4,739,884 | 4/1988 | Duplessy | 206/821 |

FOREIGN PATENT DOCUMENTS

| | | | |
|---|---|---|---|
| 472703 | 3/1929 | Fed. Rep. of Germany | 206/394 |
| 2283061 | 4/1976 | France | 206/392 |

*Primary Examiner*—David T. Fidei

*Attorney, Agent, or Firm*—Harness, Dickey & Pierce

[57] ABSTRACT

A separator holder structure for the quick loading of yarn would spools in dyeing machines, drying machines or other processing devices. The structure consists of a frame forming latticed tray which is divided internally into housings in each of which is secured, with the possibility of a limited vertical movement, a separator adapted to keep the yarn wound spools centered within the respective housing and to ensure hydraulic tightness between the vertically stacked elements in each column of spools when multiple structures are stacked. The possibility of movement of ht eseparators permits a quick stacking of the spools on horizontal layers, as the expedient allows the correct setting of separators, in individually loose manner, to ensure hydraulic tightness of same at the two ends of spools on which the yarn is wound.

29 Claims, 4 Drawing Sheets

FIG. 4.
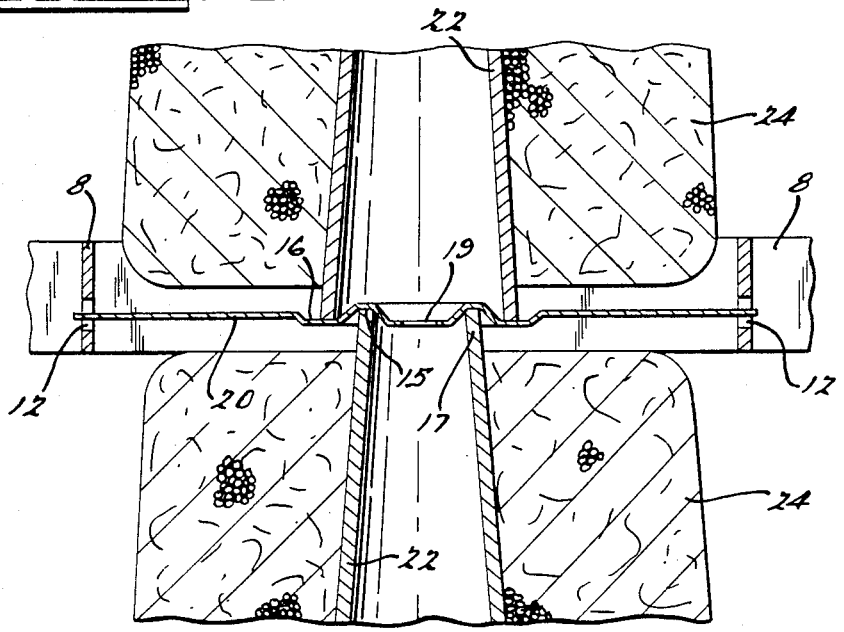
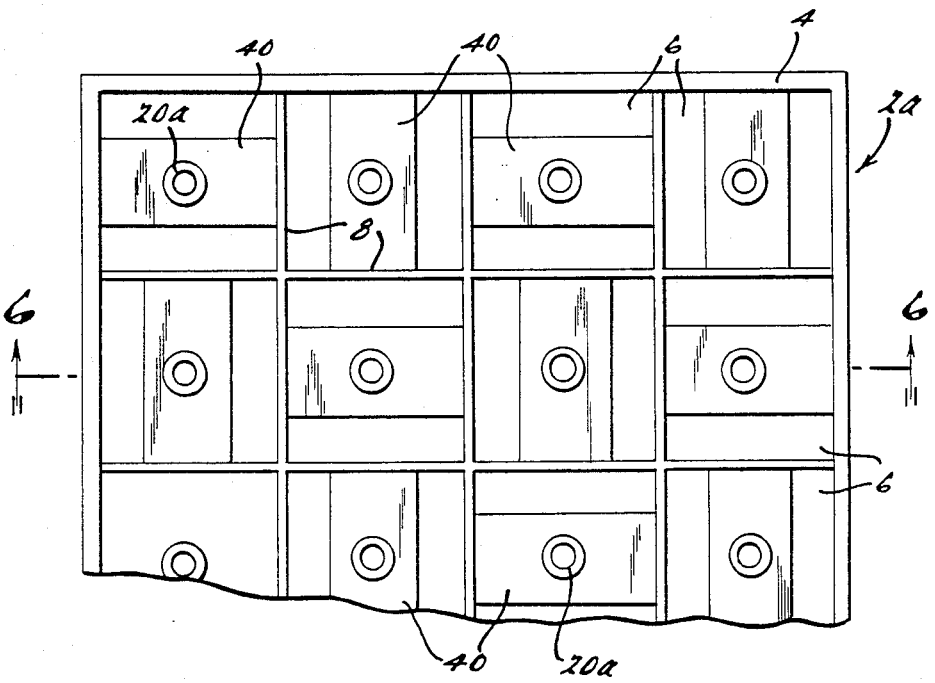
FIG. 5.

SUPPORTING STRUCTURE FOR QUICK LOADING OF YARN SPOOLS IN DYEING AND DRYING MACHINES OR OTHER PROCESSING DEVICES

BACKGROUND AND SUMMARY OF THE INVENTION

This invention relates to a separator holder structure for the quick loading of yard wound spools in dyeing machines, drying maschines or other processing devices.

The yard wound spools to be subjected to the dyeing and/or drying operations are at present stacked up by inserting them vertically in supporting rods suitably arranged in adjacent rows ready to be introduced in suitable autoclaves in which the dyeing liquid or drying air circulate.

The arrangement of the rods, viewed from the top, generally consists of a patten of rows aligned according to two perpendicular directions, but may also have different configurations, for example, as concentric rings, but always characterized by geometrical symmetry.

Between one spool and the other of a same vertical row it is always necessary to insert a suitable shaped separator for hydraulic tightness, or hydraulic seal alignment and support of each spool with the underlying one.

In the present state of the art, the use of labor for stacking the single spools and related metal separators on the rods of the dyeing autoclaves considerable increases production costs.

The purpose of this invention is to provide a device apt to expedite loading of the spools and separators in autoclaves, thereby reducing labour and consequently affording a better exploitation of the plants, whilst maintaining unaltered both the possibility of settling and the hydraulic tightness of the separators interposed between the spools.

According to the invention the separator holder structure consists of a frame forming a flat latticed tray internally subdivided into housings by two sets of inside walls perpendicular to each other and secured to the inner walls of the frame itself. A separator is secured in each compartment, with possibility of limited movement in a perpendicular direction with respect to the main surface of the frame, each separator being apt to support and maintain centered a spool of yarn, said possibility of movement being apt to compensate for any non uniformities in length or imperfect planarity of the hollow tubes on which the yard is wound. In this manner, the latticed tray structures, each compartment of which has been pre-loaded with a spool, can be superimposed one on top of the other to obtain a load of material, in horizontal layers, to be introduced into a dyeing and or drying machine.

BRIEF DESCRIPTION OF THE DRAWINGS

The invention will now be described in conjunction with the annexed drawing illustrating, by way of example an embodiment of the device and some of its variants.

In the drawings:

FIG. 4. is a cross section taken on lines IV—IV of FIG. 3 with the yarn wound spools mounted on it. FIG. 5. is a variant of th tray structure.

DESCRIPTION OF THE PREFERRED EMBODIMENT

Figure 1:
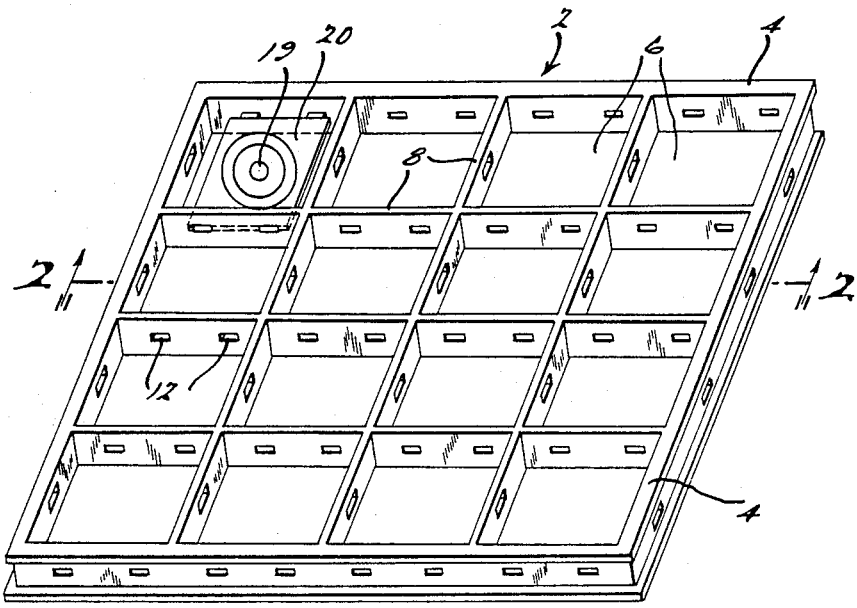
FIG. 1. is a perspective top view of a latticed tray structure according to the invention in a preferred form of the embodiment.
Figure 2:
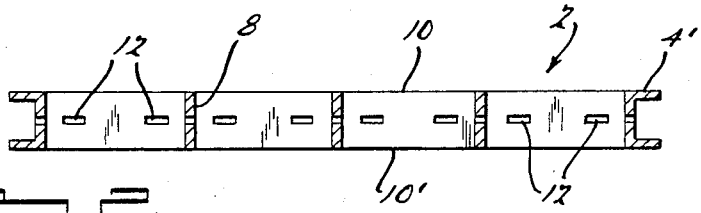
FIG. 2. is a sectional view taken on lines II—II of the structure of FIG. 1.
Figure 3:
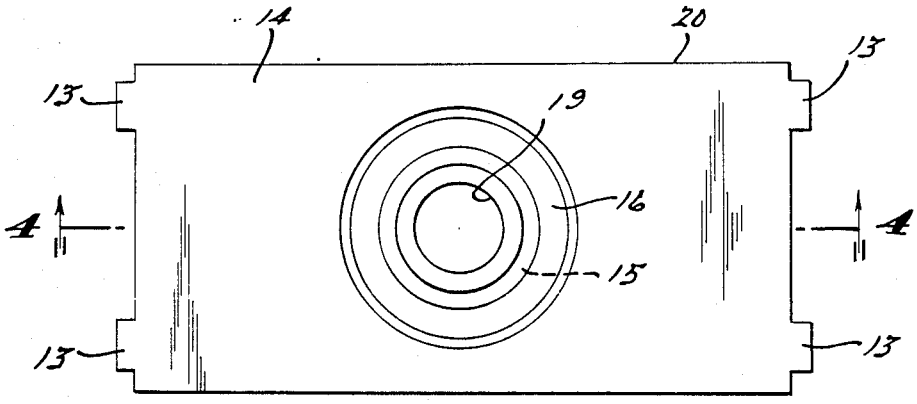
FIG. 3. is a top view of one of the separators inserted in the housings of the latticed tray structure of FIG. 1.

In FIGS. 1, 2 and 3, the separator carrying structure identified by number 2, consists of an external frame 4, quadrangular shaped in our case, realized, for example in welded C section.

The internal space, delimited by said frame is subdivided in any number of square compartments or housing 6, obtained by means of inside walls 8 parallel to the peripheral walls and internally secured to frame 4 so as to form a latticed through structure with respect to the main faces 10, 10'.

The wall of each housing 6 is provided with at least a pair of rectangular slots 12 in which are inserted fins 13 projecting from rectangular shaped laminar body 14 forming separator 20 (FIG. 3).

The separator (20), perferably made of stainless steel is shaped in the ususal manner and has circular seasrs 15, 16 (see FIG. 4) in which are centered and housed, respectively narrower top end 17 and wider end base 18 of the hollow truncated cones 22 on which the yarn is wound to form a spool 24.

Each separator 20 is also provided, in the usual manner, with a center hole 19 to permit flow of the dyeing liquid inside the spools.

The separators 20 are inserted in the single housings 6 of structure 2 by flexing elastically the separator itself so as to engage fins 13 in slots 12 on the opposite walls of each compartment, after which the separator remains imprisoned in the housing, being allowed only to move and settle itself perpendicularly with respect to planes 10, 10' of the latticed structure the amplitude of the movement being equal to the height of holes 12.

As shown in FIG. 1, separators 20 are fitted preferably perpendicularly between one housing and the adjacent one so that the fins 13 of the separators do not interfere with each other.

From what above stasted it is evident that superimposing one on the top of the other a plurality of latticed tray structures on each of which a layer of spools has been previously positoined, rapidly and easily, for example by means of mechanical loaders, any differences in height or planarity of the ends of the tubes 22 are compensated by the possibility to adjust singly each separator 20, which is free to float throughout the height of holes 12, thereby maintaining steadily horizontal the tray structure and the natural positoining of the separators themselves, thereby ensuring hydraulic tightness.

Figure 6:
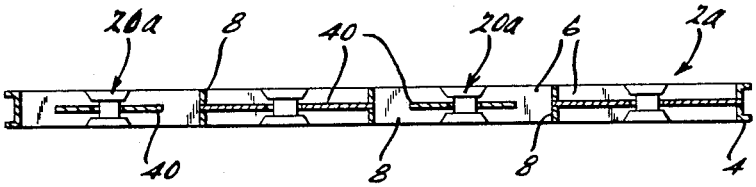
FIG. 6. is a cross sectional view taken on lines VI—VI of FIG. 5.
Figure 7:
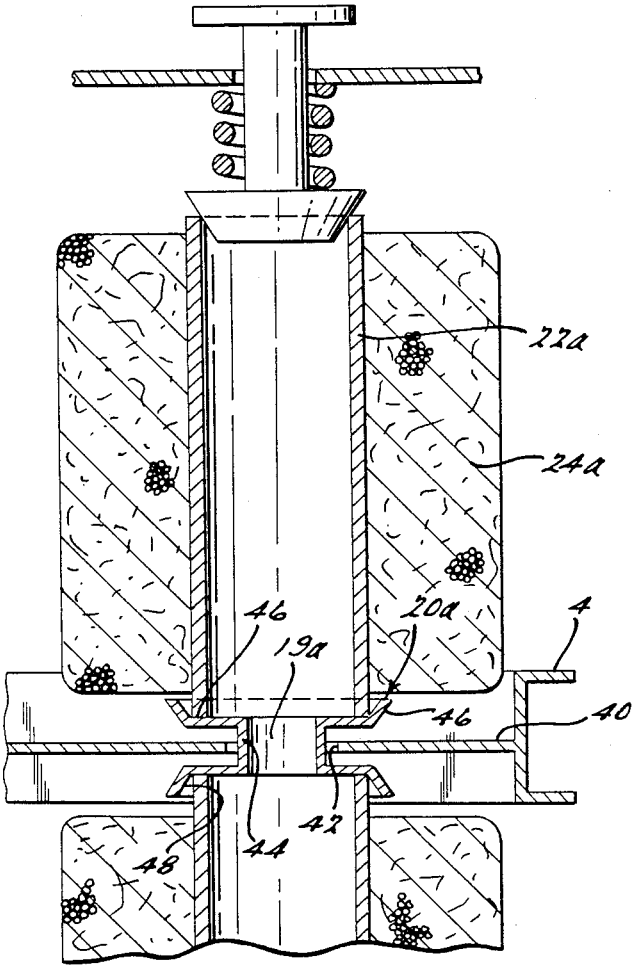
FIG. 7. is an enlarged detail of FIG. 6, showing the mounting of the cylindrical spools on the separators according to the variant of FIG. 5.

A variant of the device, covered by the domain of the invention, is shown in FIGS. 5, 6 and 7.

In said variant the latticed tray structure *2a* is the same as that previously described and illustrated, i.e. it consists of a frame 4 divided internally in housings 6 by means of inside walls 8. To said walls are secured, by welding, plates 40, each provided with a center hole 42 which retains, allowing movement in the vertical direction, a ring shaped separator 20*a* provided with a neck 44 having a cavity 19*a* and a double truncated cone flare 46, 48 to house the tubes 22, 22*a*.

Figure 8:
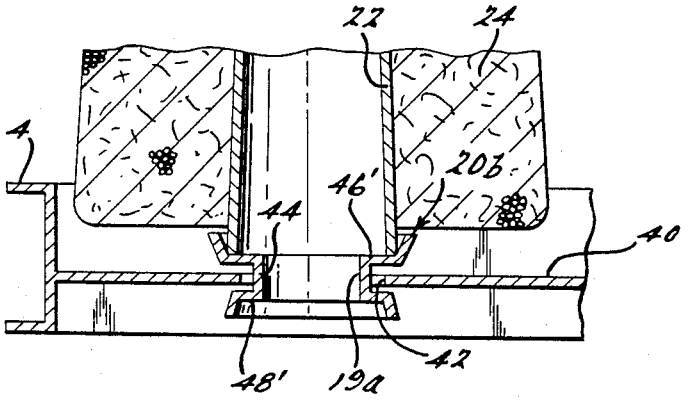
FIG. 8. is a variant of the separators of FIG. 7.

FIG. 7 clearly shows the mounting, on said floating separators, of spools wound on cylindrical hollow tubes 22*a* within which the dyeing liquid can circulate by flowing through the central cavity 19*a* of said separators. The figure also shows the top securing means, of known type, of a row of such wound spools on cylindrical tubes. In the case illustrsated in FIG. 7, seats 46, 48 are equal to each other, whilst a further variant 20*b* of the ring shaped separators as shown in FIG. 8, makes it possible to mount also conical shaped spools. In this case, separators 20*b* will be provided with truncated cone shaped flares 46' and 48', different from each other and commensurate to the respective terminal diameters of conical tubes 22.

Figure 9:
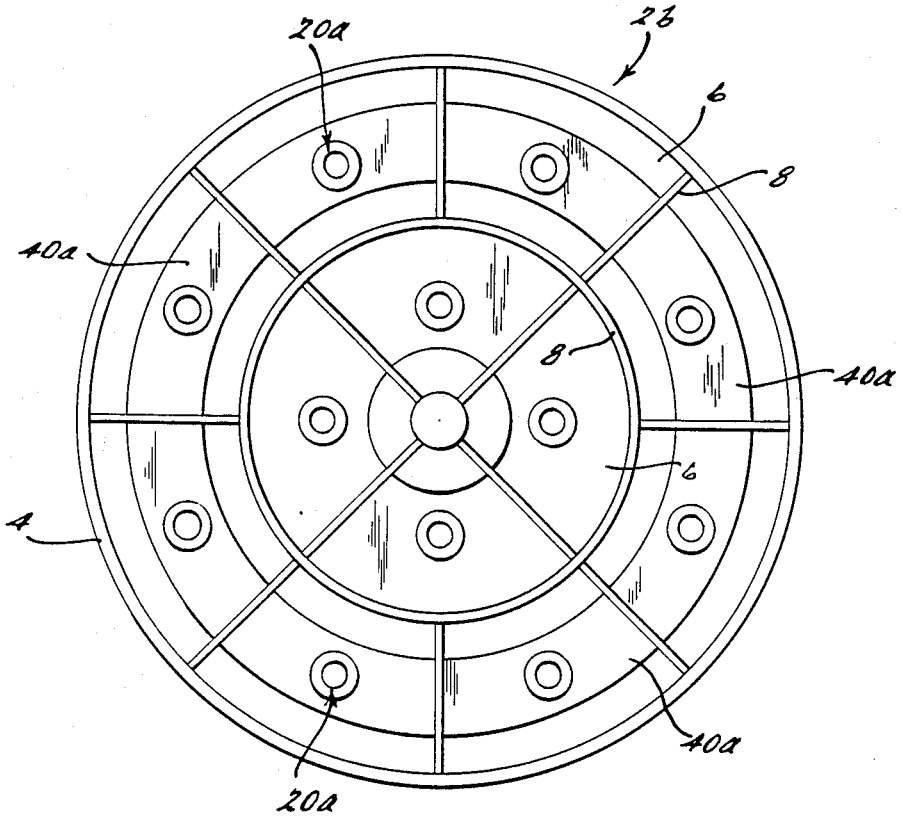
FIG. 9. is a variant in the shape of the tray structure.

Lastly, FIG. 9 shows the different form of a latticed tray structure 26 suitable for circular and vertical boilers and provided with housings 6*a*, shaped as circualr crown sectors with plates 40*a* adopted to retain type 20*a* separators as shown in FIG. 7.

Latticed tray type structures of the type discribed and illustrated are very well suited to prepare the load in dyeing or drying apparatus. In fact the structures can be mounted on conveyor belts and completed with the relevant spools with very simple loading means, while the stacking in superimposed layers of number of structures of this type is practical and expeditious, and consents the formation of a balanced load, with perfect tightness of the separators and fully stable during transport.

The use of tray structures according to the invention also does away with the use of vertical rods heretofore used to keep the rows of wound spools in alignment, thus affording simpler tooling requirements and obvious savings.

I claim:

1. Supporting structure for quick loading of yarn spools in dyeing machines, drying machines and other processing facilities, characterized in that said supporting structure consists of a frame forming a plane latticed tray subdivided internally into housings by means of a number of dividing inside walls generally perpendicular to each other and secured to the inner walls of said frame, a separator being secured in each housing so as to allow limited vertical displacement of said separator, each said separator being adapted to support and maintain centered a yarn wound spool, said allowable displacement having the purpose of compensating for any differences in the height and non perfect planarity between respective ones of said spools on which the yarn is wound, so as to ensure hydraulic tightness between said spools, a plurality of said supporting structures, previously loaded with a spool in each housing being adapted to constitute, a load of material consisting of yarn wound spools by stacking of successive ones of said plurality of said supporting structures.

2. Supporting structure for separators according to claim 1 characterized in that the wall of each housing of the structure is provided with at least a pair of rectangular slots being apt to retain in each housing, a separator which remains secured in the housing itself with limited freedom of vertical movement in said slots, each separator being formed by a rectangular shaped metal lamina having on each of its opposite sides of lesser length, at least two projecting fins which can be inserted in the corresponding slots by flexing said lamina within the elastic limits thereof.

3. Supporting structure for separators according to claim 1, characterized in that rectangular separators have a length and a width and are inserted in each of the housings preferably arranged so as to have the lengths thereof reciprocally pependicular to each other, each separator being thus perpendicular to each other contiguous separator.

4. Supporting structure for separators according to claim 1 characterized in that each housing of latticed tray structure has a plate secured between the opposite walls of said housing, the centerpart of said plate being provided centrally with a hole adapted to retain a floating separator, each separator consisting of a hollow neck provided, on its opposite ends, with two preferably truncated cone shaped seats adapted to receive and maintain centered, the respective ends of spools on which the yarn to be treated is wound, thus ensuring hydraulic tightness.

5. Supporting structure for separators saccording to claim 4, characterized in that said two seats provided on each of said separators are substsantially identical to each other.

6. Supporting structure for separators according to claim 4, characterized in that said two seats provided on each of said separators are of different diameters.

7. Supporting structure for separators according to claim 1, characterized in that each housing is quardrangular shaped.

8. Supporting structure for separators according to claim 1 characterized in that each housing is circular shaped.

9. Supporting structure for separators according to claim 1, characterized in that separators are preferably made of stainless steel.

10. Supporting structure for separators according to claim 2, characterized in that rectangular separators have a length and a width and are inserted in each of the housings preferable arranged so as to have the lengths thereof reciprocally perpendicular to each other, each separator being thus perpendicular to each other contiguous separator.

11. Supporting structure for separators according to claim 2, characterized in that each housing is quardrangular shaped.

12. Supporting structure for separators according to claim 3, characterized in that each housing is quardrangular shaped.

13. Supporting structure for separators according to claim 4, characterized in that each housing is quardrangular shaped.

14. Supporting structure for separators according to claim 5, characterized in that each housing is quardrangular shaped.

15. Supporting structure for separators according to claim 6, characterized in that each housing is quardrangular shaped.

16. Supporting structure for separators accordig to claim 10, characterized in that each housing is quardrdangular shaped.

17. Supporting structure for separators according to claim 2 charaterized in that each housing is circular shaped.

18. Supporting structure for separators according to claim 3 characterized in that each housing is circular shaped.

19. Supporting structure for separators according to claim 4 characterized in that each housing is circular shaped.

20. Supporting structure for separators according to claim 5 characterized in that each housing is circular shaped.

21. Supporting structure for separators according to claim 6 characterized in that each housing is circular shaped.

22. Supporting structure for separators according to claim 10 characterized in that each housing is circular shaped.

23. Supporting structure for separators according to claim 2, characterized in that separators are preferably made of stainless steel.

24. Supporting structure for separators according to claim 3, charcterized in that separators are preferably made of stainless steel.

25. Supporting structure for separators according to claim 4, characterized in that separators are preferably made of stainless steel.

26. Supporting structure for separators according to claim 5, characterized in that separators are preferably made of stainless steel.

27. Supporting structure for separators according to claim 6, characterized in that separators are preferably made of stainless steel.

28. Supporting structure for separators according to claim 7, characterized in that separators are preferably made of stainless steel.

29. Supporting structure for separators according to claim 8, characterized in that separators are preferably made of stainless steel.

* * * * *

UNITED STATES PATENT AND TRADEMARK OFFICE

CERTIFICATE OF CORRECTION

PATENT NO. : 4,967,907

DATED : November 6, 1990

INVENTOR(S) : Leopoldo Pozzi

It is certified that error appears in the above-identified patent and that said Letters Patent is hereby corrected as shown below:

Abstract, line 2, "would" should be --wound--.

Abstract, line 4, after "forming" insert --a--.

Abstract, line 11, "he" should be --the--.

Abstract, line 11, "eseparators" should be --separators--.

Column 1, line 10, "yard" should be --yarn--.

Column 1, line 11, "maschines" should be --machines--.

Column 1, line 13, "yard" should be --yarn--.

Column 1, line 20, "patten" should be --pattern--.

Column 1, line 33, "considerable" should be --considerably--.

Column 1, line 53, "yard" should be --yarn--.

Column 1, line 62, "drawing" should be --drawings--.

Column 2, line 6, begin new paragraph with the second occurrence of "FIG.".

Column 2, line 7, "th" should be --the--.

Column 2, line 7, begin new paragraph with "FIG.".

UNITED STATES PATENT AND TRADEMARK OFFICE

CERTIFICATE OF CORRECTION

PATENT NO. : 4,967,907

DATED : November 6, 1990

INVENTOR(S) : Leopoldo Pozzi

It is certified that error appears in the above-identified patent and that said Letters Patent is hereby corrected as shown below:

Column 2, line 8, begin new paragraph with the second occurrence of "FIG.".

Column 2, line 11, begin new paragraph with the second occurrence of "FIG.".

Column 2, line 12, begin new paragraph with the second occurrence of "FIG.".

Column 2, line 32, "ususal" should be --usual--.

Column 2, line 32, "seasrs" should be --seats--.

Column 2, line 52, "stasted" should be --stated--.

Column 2, line 55, "positoined" should be --positioned--.

Column 2, line 61, "positoining" should be --positioning--.

Column 3, line 13, "illustrsated" should be --illustrated--.

Column 3, line 23, "circualr" should be --circular--.

Column 3, line 24, "adopted" should be --adapted--.

Column 3, line 26, "discribed" should be --described--.

Column 3, line 65, Claim 2, "apt" should be --adapted--.

Column 4, line 9, Claim 3, "pependicular" should be --perpendicular--.

UNITED STATES PATENT AND TRADEMARK OFFICE

CERTIFICATE OF CORRECTION

PATENT NO. : 4,967,907

DATED : November 6, 1990

INVENTOR(S) : Leopoldo Pozzi

It is certified that error appears in the above-identified patent and that said Letters Patent is hereby corrected as shown below:

Column 4, line 23, Claim 5, "saccording" should be --according--.

Column 4, line 25, Claim 5, "substsantially" should be --substantially--.

Column 4, lines 32-33, Claim 7, "quardrangular" should be --quadrangular--.

Column 4, line 43, Claim 10, "preferable" should be --preferably--.

Column 4, lines 48-49, Claim 11, "quardrangular" should be --quadrangular--.

Column 4, lines 51-52, Claim 12, "quardrangular" should be --quadrangular--.

Column 4, lines 54-55, Claim 13, "quardrangular" should be --quadrangular--.

Column 4, lines 57-58, Claim 14, "quardrangular" should be --quadrangular--.

Column 4, lines 60-61, Claim 15, "quardrangular" should be --quadrangular--.

UNITED STATES PATENT AND TRADEMARK OFFICE

CERTIFICATE OF CORRECTION

PATENT NO. : 4,967,907

DATED : November 6, 1990

INVENTOR(S) : Leopoldo Pozzi

It is certified that error appears in the above-identified patent and that said Letters Patent is hereby corrected as shown below:

Column 4, line 62, Claim 16, "accordig" should be --according--.

Column 4, lines 63-64, Claim 16, "quardrangular" should be --quadrangular--.

Column 4, line 67, Claim 17, "charaterized" should be --characterized--.

Column 6, line 2, Claim 24, "charcterized" should be --characterized--.

Signed and Sealed this

Sixteenth Day of June, 1992

*Attest:*

DOUGLAS B. COMER

*Attesting Officer*

*Acting Commissioner of Patents and Trademarks*